United States Patent [19]

Cosgrove

[11] Patent Number: 4,981,292

[45] Date of Patent: Jan. 1, 1991

[54] SWING-UP LOADER FOR SIGNATURE MACHINES

[75] Inventor: James F. Cosgrove, Western Springs, Ill.

[73] Assignee: McCain Manufacturing Corporation, Chicago, Ill.

[21] Appl. No.: 257,214

[22] Filed: Oct. 3, 1988

[51] Int. Cl.[5] ..... B65H 1/02

[52] U.S. Cl. ..... 271/150; 271/157; 271/162; 270/54; 414/795.8

[58] Field of Search ..... 271/150, 3.1, 147, 149, 271/157, 162, 171, 69, 258; 221/11, 10, 17; 414/795.8; 270/54

[56] References Cited

U.S. PATENT DOCUMENTS 3,655,072 4/1972 Bateman ..... 414/795.8 X
4,177,982 12/1979 Bewersdorf et al. ..... 271/150 X
4,241,907 12/1980 McCain et al. ..... 270/54
4,588,180 5/1986 Ballestrazzi et al. ..... 271/150 X
4,697,973 10/1987 Hahn et al. ..... 271/150 X

*Primary Examiner*—David H. Bollinger
*Attorney, Agent, or Firm*—Kinzer, Plyer, Dorn, McEachran & Jambor

[57] ABSTRACT

A swing-up loader for a signature machine serves as an extension for the pile feed mechanism. The loader has its own conveyor belts and drive. When placed in its operating position, the loader adjoins the regular infeed of the signature feeder at a junction. A microswitch senses the height of the signature pile at the junction. When the pile height falls due to removal of signatures at the stockplate, the microswitch calls for movement of the loader's drive belts. This movement transfers signatures on the loader across the junction to the regular infeed of the signature feeder. The loader maintains a full infeed to assure a uniform pressure at the stockplate.

15 Claims, 2 Drawing Sheets

SWING-UP LOADER FOR SIGNATURE MACHINES

BACKGROUND OF THE INVENTION

This invention relates to signature machines of the type shown in McCain U.S. Pat. No. 4,241,907. Signatures are folded, printed sheets. A signature machine feeds signatures from individual pockets onto a saddle conveyor to create a book. A stack or pile of signatures is loaded into the infeed hopper of a signature machine. An extractor mechanism withdraws individual signatures one at a time from the front of the stack. The extractor may include pile suckers, an extracting cylinder, a lap cylinder and an opening cylinder, as fully set forth in McCain U.S. Pat. No. 4,241,907, the disclosure of which is incorporated by reference herein. The extractor deposits the signatures on the saddle conveyor.

An infeed conveyor is mounted in the hopper. A ratchet or one way clutch mechanism drives the infeed conveyor to advance signatures toward the front of the pile. This device can be controlled to advance the pile in very small increments, something approaching the thickness of a signature. An infeed governor pin activates the infeed conveyor motion in response to removal of signatures from the pile. This relatively fine control, however, limits the size of the infeed hopper. The mechanism simply is not powerful enough to handle heavy loads on the infeed conveyor.

The infeed hopper must present signatures to the extractor in a loose condition wherein they are free to settle down and get picked up by the pile suckers. To this end, the infeed hopper has side guides which are angled inwardly to hold back the pile and take excessive pressure off the signatures near the stockplate. But to whatever degree the side guides hold back the pile, the condition of the signatures at the front of the pile will be affected by the pressure of signatures near the back of the pile. The ideal condition results from uniform pressure. The side guides can be adjusted to provide the correct resistance to the pile if the pressure is uniform. However, uniform pressure cannot be ideally attained by hand loading of the hopper. Variable pressure inevitably results as the infeed goes from full to partially empty The problems of hand loading are further compounded by the size limitations of the infeed hopper. Since the hopper cannot be made very large, an operator must frequently reload it to achieve the desired uniform pressure. A more likely scenario is that the hopper will not get constant attention and the extractor will operate under less than ideal conditions. The swing-up loader of the present invention solves these problems by maintaining a uniform stack or pile in the infeed hopper of the signature feeder.

SUMMARY OF THE INVENTION

This invention relates to a method and apparatus for supplying a pile of signatures to the infeed hopper of a signature feeder.

Specifically, the invention is concerned with a swing-up loader which is pivotable between operating and storage positions. It is desirable to be able to pivot the loader to a storage position because there will be times when it is not needed. For example, there may be times when not all feeders are in use. Or, odd types of signatures, such as cards, must be hand loaded. In these situations it is convenient or necessary to deactivate the extension by lowering it. In the storage position the loader is located in an out-of-the-way position where it will not interfere with manual loading of the infeed hopper. In the operating position the swing-up loader is aligned with the infeed of the signature feeder such that signatures can be transferred from the loader to the infeed at a junction. In effect, the loader is an extension of the infeed conveyor.

The swing-up loader has a frame on which an endless conveyor is mounted. The conveyor has its own motor and drive train. A mounting plate attached to the side frames of the signature feeder supports the motor, drive train and loader frame. The drive train need not be disconnected when the loader is moved between the operating and storage positions.

As mentioned above, the infeed conveyor advances its signature pile in fine increments in response to withdrawal of signatures. The loader conveyor, on the other hand, operates intermittently in coarse increments. As signatures are taken away by the extractor, signatures in the hopper immediately move forward while those on the loader do not. Thus, the loader's signatures lean forward slightly and the pile height at the junction between the loader and the infeed hopper falls. A microswitch is mounted above the pile a the junction. The microswitch detects the height of the signature pile and activates the loader conveyor drive motor when the pile height falls below a predetermined level. Thus, the conveyor on the swing-up loader operates intermittently as needed to maintain the pile height at the junction. The result is a fully loaded infeed hopper.

DETAILED DESCRIPTION OF THE INVENTION

Figures 1, 4:
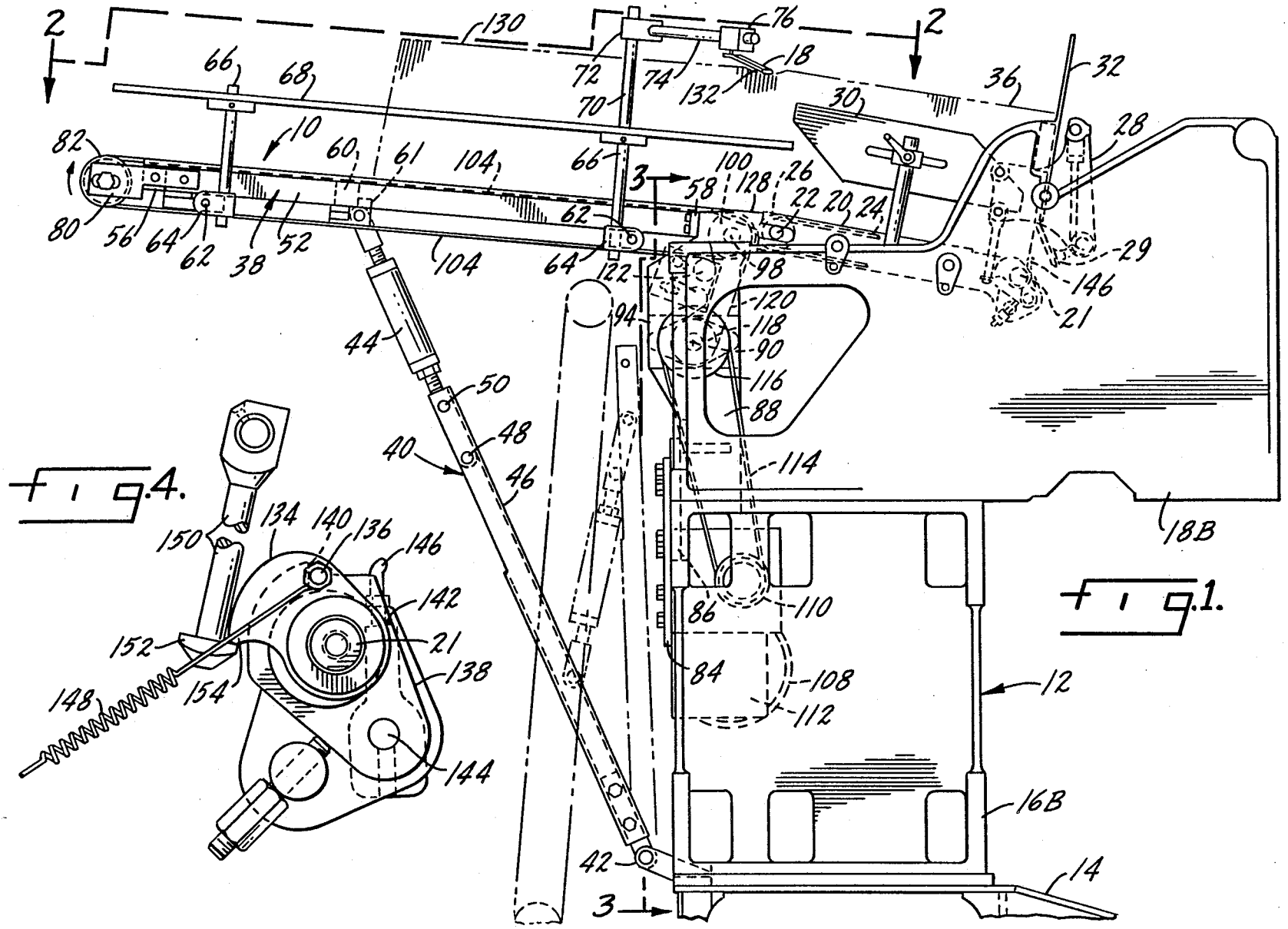
FIG. 1 is a side elevation view of the swing-up loader of the present invention attached to a signature feeder.
FIG. 4 is a side elevation view, on an enlarged scale, of the infeed conveyor drive mechanism.
Figure 2:
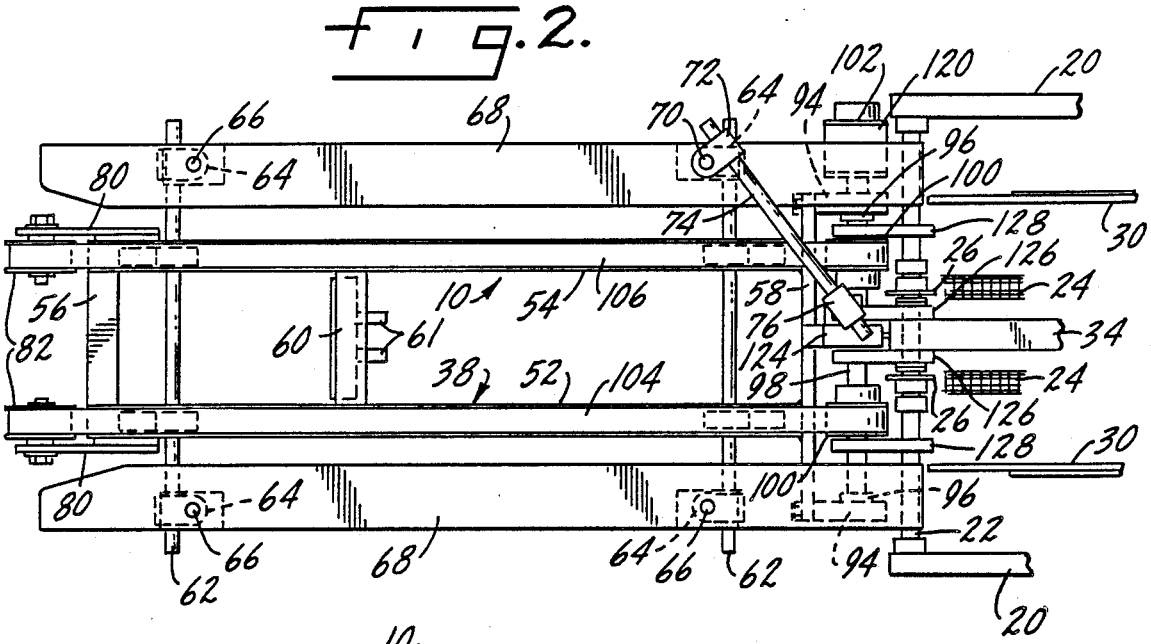
FIG. 2 is a plan view looking in the direction of line 2—2 of FIG. 1.
Figure 3:
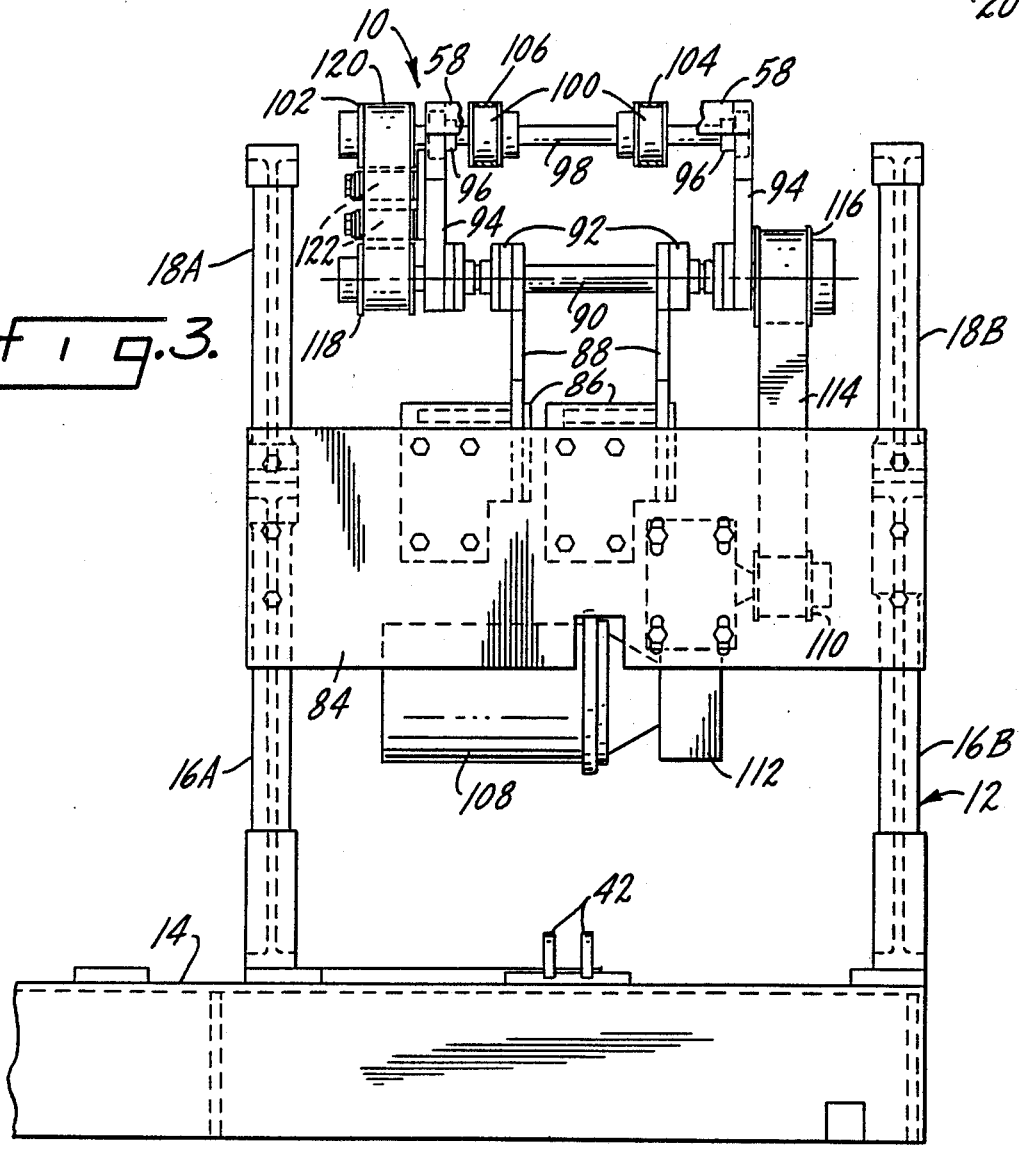
FIG. 3 is a front elevation view looking in the direction of line 3—3 of FIG. 1.

FIGS. 1–3 illustrate the swing-up loader 10 of the present invention. The loader is attached to a signature feeder 12. The feeder has a base 14, left and right lower side frames 16A, 16B and left and right upper side frames 18A, 18B.

The upper side frames 18 mount an infeed assembly between them. Portions of the infeed assembly are shown in FIGS. 1 and 2. A pair of side plates 20 rotatably mount a drive shaft 21 and fixably mount an infeed shaft 22. A pair of double strand roller chains 24 define an infeed conveyor Shafts 21 and 22 define the head and tail ends of the infeed conveyor, respectively. The drive shaft 21 has sprockets (not shown) which drive the chains 24. Chains 24 also revolve on sprockets 26 rotatably mounted on the shaft 22. A one-way clutch mechanism or a ratchet actuates the drive shaft 21. Details of a suitable clutch mechanism will be described below.

The infeed assembly further includes a pile sucker cam follower lever 28. Pile suckers 29 are actuated by lever 28. The pile suckers grab the front signature and carry it to the usual extracting cylinder (not shown here but fully described in McCain U.S. Pat. No. 4,241,907). The infeed assembly is completed by a pair of adjustable side guides 30, a stockplate 32 and a bottom support member 34. Together these elements define the infeed hopper in which a first pile of signatures rests, as schematically shown at 36 in FIG. 1.

The swing-up loader 10 comprises a conveyor frame 38 which is pivotally connected to the signature feeder 12. A collapsible brace 40 supports the frame 38. The brace 40 is pinned to a bracket 42 on the base 14. An adjuster 44 controls the angle of the frame 38. Preferably the adjuster's length is set to hold the frame at an angle between 0 and 5 degrees above horizontal. The adjuster 44 is pivotally connected to a tube 46 by pin 48. A removable pin 50 locks the adjuster in line with the tube. When the pin 50 is removed the loader can be swung to a storage position indicated in phantom lines in FIG. 1.

The loader frame 38 includes two elongated belt support beams 52 and 54. The belt support beams are rectangular tubes. Outer and inner cross members 56 and 58 connect the ends of the belt support beams. The inner cross member 58 extends beyond the sides of the beams for connection to brackets, as will be explained below. The cross members are welded to the beams. The frame further includes a central cross piece 60 welded to the beams. The cross piece 60 has lugs 61 for attachment of the collapsible brace member 40.

The frame also has two transverse rods 62 which are fixed to the belt support beams 52, 54. Rods 62 slidably mount four blocks 64. The blocks adjustably support uprights 66. The uprights mount a pair of elongated side guides 68. The blocks 64 provide adjustability, both vertically and horizontally for the side guides 68.

One of the uprights 66 includes an extension portion 70. A mounting block 72 is adjustably fixed on the extension 70. The block carries an arm 74 to which a microswitch 76 is connected. The microswitch has a finger 78 (FIG. 1) which contacts the top of the signature pile at the junction between the swing-up loader and the infeed assembly of the signature feeder. The mounting block 72 and arm 74 are adjustable so that the microswitch 76 can be positioned over the junction. It will be understood that other types of detectors, such as a photocell, could be substituted for the microswitch.

The frame 38 further includes a pair of extensions 80 connected to the outer ends of the belt support beams 52, 54. The extensions adjustably mount pulleys 82 for rotation.

The connection of the frame to the signature feeder 12 is best seen in FIG. 3. Bolts fasten a main mounting plate 84 to the side frames 16 and 18. Two brackets 86 are bolted to the main mounting plate 84. The brackets 86 support a pair of upright plates 88. The plates rotatably mount a first shaft 90 in bearings 92. A pair of brackets 94 are pivotally mounted on the shaft 90. As mentioned above, the ends of the frame cross member 58 are welded to the brackets 94. Thus, the frame is attached to the brackets 94 and is thereby mounted for rotation about the shaft 90. The brackets 94 carry bearings 96 which rotatably mount a second shaft 98. Shaft 98 upholds a pair of belt pulleys 100 and a drive pulley 102.

A loader conveyor comprising a pair of drive belts is mounted on the frame 38. The belts are shown at 104 and 106. The forward run of the belts rests on top of the belt support tubes 52, 54. The belts revolve around pulleys 82 and 100. The belts revolve in a clockwise direction, as seen in FIG. 1.

The drive mechanism for the loader conveyor includes a motor 108 mounted on the main mounting plate 84. The motor drives a pulley 110 through a reducer 112. A gear belt 114 drives the first shaft 90 through a pulley 116, which is mounted on the shaft. A pulley 118 mounted on the opposite end of shaft 90 drives a timing belt 120. The timing belt in turn drives the pulley 102, causing shaft 98 to rotate. Rotation of pulleys 100 on the shaft 98 causes motion of the conveyor belts 104, 106. A pair of idlers 122 may be adjustably mounted on one of the brackets 94 to control the tension on the timing belt 120.

FIG. 2 best illustrates the junction between the swing-up loader and the infeed hopper of the signature feeder. The junction area extends approximately from the cross member 58 to the shaft 22. It is in this area that signatures are transferred from the swing-up loader to the infeed assembly. Several guides are provided to support the signatures as they transfer from one conveyor to the other. A center support 124 is attached to the top of the cross member 58. A pair of inner guides 126 are located adjacent the center guide 124. Outer guides 128 are arranged outside of the conveyor pulleys 100. Guides 126 and 128 are fixedly attached to the shaft 22 and extend over but not in contact with the second shaft 98.

FIG. 4 illustrates details of a clutch mechanism suitable for driving the infeed conveyor drive shaft 21. A one-way clutch 134 is mounted on shaft 21. The clutch has a stop pin 136 extending from it into a notch or cutout in a control lever 138. The extremities of the notch are indicated at 140 and 142. The control lever 138 is fixed to a governor pin shaft 144. A governor pin 146 is also fixed on shaft 144. The pin is disposed such that it contacts the foremost signature in the infeed pile. Governor pin 146 is urged against the signatures by a spring 148. The spring 148 biases the clutch 134 counter-clockwise (as seen in FIG. 4), thereby pulling the clutch stop pin 136 against the limit 140 of the control lever notch. This biases control lever 138 counterclockwise, thereby acting similarly on the governor pin 146.

A reciprocating drive link 150 is connected to lever 28 (FIG. 1) and is movable in a fixed stroke by that lever. A head 152 on the link engages a corner 154 of the clutch housing to rotate the clutch in a clockwise fashion on an upstroke of the link. The clutch 134 has small one-way bearings in it, which engage the drive shaft 21 only when the clutch moves clockwise. During a downstroke of link 150 the spring 148 pulls clutch 134 counterclockwise. The clutch releases drive shaft 21 during this return motion so the shaft does not return with the clutch. A second one-way clutch may be mounted on shaft 21 to assure that it will remain fixed during a downstroke of the link 150.

The governor pin 146 controls the angular position of the control lever 138 and its notch limit 140. The position of the notch limit 140 controls the relation between the corner 154 of the clutch and the head 152 of the link. This relation in turn controls the amount of clutch rotation per upstroke of the link, thereby controlling the amount of rotation of drive shaft 21. As each signature is withdrawn, the governor pin 146 senses its absence and lowers the control lever 138, i.e., moves it counterclockwise. This allows the clutch 134 to move backwardly with the control lever under the bias of spring 148. On the next cycle, the reciprocating drive link 150 will turn the housing forward (i.e., clockwise), advancing the shaft 21 and chains 24 that same distance. Thus, it can be seen that the clutch mechanism provides very fine increments of feed for each cycle.

The use, operation and function of the swing-up loader are as follows. Prior to initial start-up of the signature feeder, a first pile of signatures is loaded in the infeed hopper. This pile is indicated at 36 in FIG. 1. With the swing-up loader 10 in the operating position shown in FIG. 1, a second pile of signatures is placed on the loader. This pile is indicated schematically at 130. The second pile on the loader is supported by the beams 52, 54 and side guides 68.

At the front of the infeed hopper, signatures against the stockplate 32 are always loose, for easy and reliable takeaway by the pile suckers 29 and extracting cylinder. As signatures are withdrawn at the stockplate, the governor pin activates the infeed conveyor 24 in response to removal of signatures, as described above. The infeed conveyor moves in fine increments, with the chains advancing a distance approximately equal to the thickness of a signature. The infeed conveyor keeps signatures against the stockplate always in a loose condition for easy and reliable takeaway by the pile suckers 29. This is an ideal condition which is more easily obtained when uniform pressure from the back of the pile is applied to the front of the pile.

The signature supply in the present invention is divided into two piles. The hopper holds one pile 36 and the loader 10 holds an adjacent pile 130. When signatures are removed at the stockplate, the pile 36 is advanced virtually immediately, but the pile 130 is not so advanced. Thus, the signatures at the front of the pile 130 tend to lean forwardly against those at the back of the pile 36, resulting in a decrease in height at the junction between the two conveyors. This decrease or slumping is illustrated at 132 in FIG. 1. The finger 78 of the microswitch 76 detects the decrease in height. The microswitch sends a signal which activates motor 108 and drives the conveyor belts 104, 106 forwardly. This happens every time the switch 76 senses a decrease in the height of the pile. As a result the hopper is kept fully loaded.

One of the advantages of the present invention is the loader conveyor's motor 108 and accompanying drive train are powerful enough to handle a large load. This permits a large supply of signatures to be placed on the loader so the feeder can operate unattended for long periods of time. Also, the motor 108 can be operated intermittently as needed to refill the infeed hopper. In the embodiment shown, the drive motor 108 is activated in response to a drop in pile height. It could also be activated in response to a count of extracted signatures, or to a hopper pile pressure measurement. Or the motor could be activated on a time basis, or some other criteria.

It will be noted that whereas the infeed conveyor moves after each withdrawal of a signature, the loader conveyor moves only after withdrawal of many signatures. So the infeed conveyor may be considered to move substantially continuously while the loader conveyor, relatively speaking, moves only intermittently.

Whereas a preferred form of the invention has been shown and described, it will be realized that alterations and modifications may be made thereto without departing from the scope of the following claims.

I claim:

1. In a signature gathering machine of the type having a frame which supports a signature feeder, an infeed hopper suitable for supporting one pile of signatures and an infeed conveyor at the bottom of said hopper for advancing individual signatures of said one pile to the signature feeder, the improvement comprising a loader for supplying additional signatures to the infeed hopper of the signature feeder, comprising:

a loader conveyor mounted on a conveyor frame, the conveyor frame being connectable to the signature feeder, the conveyor frame being adapted for mounting in an operating position wherein said conveyor is aligned with the infeed hopper of the signature feeder such that the additional signatures can be transferred from the loader conveyor to the infeed hopper at a junction;

drive means for driving the loader conveyor;

pile sensing means for detecting the size of said one pile of signatures in the infeed hopper; and control means responsive to the pile sensing means for activating the drive means when the size of said one pile in the infeed hopper falls below a predetermined level.

2. The loader of claim 1 further characterized in that the conveyor frame is pivotally connected to the signature feeder such that when not in use the loader can be pivoted from its operating position to a storage position.

3. The loader of claim 2 wherein the loader is pivoted near the end of the conveyor frame adjacent to the signature feeder.

4. The loader of claim 2 wherein the loader extends generally horizontally from the signature feeder and is supported by a collapsible brace member.

5. The loader of claim 1 wherein the loader extends generally horizontally from the signature feeder and is supported by a brace member.

6. The loader of claim 1 wherein the pile sensing means is a microswitch.

7. The loader of claim 1 further comprising a mounting plate adapted for attachment to the frame which supports the signature feeder, with the drive means and conveyor frame supported on the mounting plate.

8. The loader of claim 7 wherein the drive means further comprises a first shaft mounted for rotation on extension plates connected to the mounting plate, a pair of brackets each mounted on one end on the first shaft, and a second shaft mounted for rotation on the other end of the brackets, the second shaft carrying pulleys which drive the conveyor.

9. The loader of claim 8 wherein the conveyor frame is mounted on the second shaft.

10. The loader of claim 1 further characterized in that the signatures of said one pile of signatures and said additional signatures define a standing stack which spans said junction, each signature in the standing stack having one edge adjacent one of the infeed conveyor or the loader conveyor and an upstanding edge opposite said one edge, the collective upstanding edges defining the height of the stack, and the pile sensing means detects the size of said one pile in the infeed hopper by detecting the height of the stack of signatures at the junction between the loader conveyor and the infeed hopper and the control means activates the drive means when the stack height falls below a predetermined level.

11. A method of supplying a pile of signatures to the infeed hopper of a signature feeder, comprising the steps of:

placing signatures in a pile on a conveyor mounted on a frame which is attached to the signature feeder, the conveyor being aligned with the infeed hopper of the signature feeder such that the signatures can be transferred from the conveyor to the infeed hopper at a junction;

detecting the height of the pile of signatures at the junction between the conveyor and the infeed hopper; and activating the conveyor when the detected pile height falls below a predetermined level.

12. The method of claim 11 wherein the step of detecting the height of the pile of signatures is characterized by placing a microswitch above the pile at the junction between the conveyor and the infeed hopper in contact with the pile.

13. In a signature gathering machine of the type having a signature feeder, the feeder including an extractor for transferring individual signatures, the improvement comprising means for supplying a pile of signatures to the extractor of the signature feeder, comprising:

a first conveyor mounted on the signature feeder and arranged to advance a pile of signatures placed thereon to the extractor;

first drive means for driving the first conveyor;

infeed governor means for activating the first drive means in response to removal of signatures from the pile by the extractor;

a second conveyor mounted on a frame which is attached to the signature feeder, the second conveyor being aligned with the first conveyor such that signatures placed thereon adjoin said pile of signatures and can be transferred from the second conveyor to the first conveyor at a junction;

second drive means for driving the second conveyor;

pile sensing means for detecting the size of the pile of signatures on the first conveyor; and control means responsive to the pile sensing means for activating the second drive means when the size of the pile on the first conveyor falls below a predetermined level.

14. The loader of claim 13 further characterized in that the pile sensing means detects the size of the pile on the first conveyor by detecting the height of the pile of signatures at the junction between the first and second conveyors and the control means activates the second drive means when the pile height falls below a predetermined level.

15. A method of supplying signatures to the extractor of a signature feeder, comprising the steps of:

advancing a first pile of signatures on a first conveyor toward the extractor in response to removal of signatures from the first pile by the extractor; and advancing a second pile of signatures on a second conveyor onto the first conveyor, detecting the pile height of signatures at the junction of the first pile with the second pile and activating the second conveyor in response to such detection to maintain a substantially uniform pile height at said junction.

* * * * *

UNITED STATES PATENT AND TRADEMARK OFFICE

CERTIFICATE OF CORRECTION

PATENT NO. : 4,981,292

DATED : January 1, 1991

INVENTOR(S) : James F. Cosgrove

It is certified that error appears in the above-identified patent and that said Letters Patent is hereby corrected as shown below:

On the title page: Item [22], delete "Oct. 3, 1988" and substitute therefor --Oct. 13, 1988.--.

Signed and Sealed this

Seventh Day of December, 1993

*Attest:*

*Attesting Officer*

Bruce Lehman

BRUCE LEHMAN

*Commissioner of Patents and Trademarks*